US010762813B2

(12) United States Patent
Yuan

(10) Patent No.: US 10,762,813 B2
(45) Date of Patent: Sep. 1, 2020

(54) METHOD AND DEVICE FOR DETECTING DEFICIENCY OF EXTERNAL COMPENSATION LINE, AND DISPLAY MODULE

(71) Applicants: BOE TECHNOLOGY GROUP CO., LTD., Beijing (CN); HEFEI XINSHENG OPTOELECTRONICS TECHNOLOGY CO., LTD., Anhui (CN)

(72) Inventor: Can Yuan, Beijing (CN)

(73) Assignees: BOE TECHNOLOGY GROUP CO., LTD., Beijing (CN); HEFEI XINSHENG OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 0 days.

(21) Appl. No.: 15/988,446

(22) Filed: May 24, 2018

(65) Prior Publication Data

US 2019/0108777 A1 Apr. 11, 2019

(30) Foreign Application Priority Data

Oct. 11, 2017 (CN) ..... 2017 1 0940689

(51) Int. Cl.

| | |
|---|---|
| ***G09G 3/00*** | (2006.01) |
| ***G09G 3/3291*** | (2016.01) |
| ***G09G 3/3258*** | (2016.01) |

(52) U.S. Cl.

CPC ..... *G09G 3/006* (2013.01); *G09G 3/3258* (2013.01); *G09G 3/3291* (2013.01); *G09G 2300/043* (2013.01); *G09G 2300/0819* (2013.01)

(58) Field of Classification Search

None

See application file for complete search history.

(56) References Cited

U.S. PATENT DOCUMENTS

2013/0257845 A1* 10/2013 Chaji ..... G09G 3/3291 345/212
2016/0125811 A1* 5/2016 Park ..... G09G 3/3258 345/694

(Continued)

FOREIGN PATENT DOCUMENTS

| | | | |
|---|---|---|---|
| CN | 104392691 | A | 3/2015 |
| CN | 105096786 | A | 11/2015 |
| CN | 105741761 | A | 7/2016 |

OTHER PUBLICATIONS

First Office Action for Chinese Application No. 201710940689.X, dated Dec. 26, 2019, 6 Pages.

*Primary Examiner* — Andre L Matthews
(74) *Attorney, Agent, or Firm* — Brooks Kushman P.C.

(57) ABSTRACT

The present disclosure provides a method and a device for detecting an external compensation line and a display module. The method includes steps of: within a resetting time period of each detection stage, applying a resetting voltage to the external compensation line and entering a detection time period after a resetting duration; and within the detection time period of each detection stage, controlling the external compensation line to be in a floating state, applying a data voltage to a data line, applying a power source voltage to a power source voltage input end, applying a data write-in control voltage to a data write-in control end, applying an external compensation control voltage to an external compensation control end, detecting a voltage across the external compensation line after a detection duration, and determin- (Continued)

ing whether or not there is a short circuit for the external compensation line in accordance with the voltage across the external compensation line.

9 Claims, 5 Drawing Sheets

(56) References Cited

U.S. PATENT DOCUMENTS

| | | | | |
|---|---|---|---|---|
| 2016/0189625 | A1 | 6/2016 | Kim et al. | |
| 2016/0343278 | A1* | 11/2016 | Tsujita | G09G 3/3233 |
| 2017/0053577 | A1 | 2/2017 | Cao et al. | |
| 2018/0090064 | A1* | 3/2018 | Liu | G09G 3/3208 |
| 2019/0304362 | A1* | 10/2019 | Yuan | G09G 3/3233 |
| 2020/0058252 | A1* | 2/2020 | Kim | G09G 3/3258 |

* cited by examiner

METHOD AND DEVICE FOR DETECTING DEFICIENCY OF EXTERNAL COMPENSATION LINE, AND DISPLAY MODULE

CROSS-REFERENCE TO RELATED APPLICATION

This application claims priority to Chinese Patent Application No. 201710940689.X filed on Oct. 11, 2017, which is incorporated herein by reference in its entirety.

TECHNICAL FIELD

The present disclosure relates to the detection of display deficiency, in particular to a method and a device for detecting a deficiency of an external compensation line, and a display module.

BACKGROUND

During the manufacture of an organic light-emitting diode (OLED) display panel, due to a complex circuit design, a manufacture process is highly demanded, and many deficiencies may occur. In addition, for an external compensation pixel driving circuit, in the case that a short circuit occurs for an external compensation line, a compensation effect of pixels in a column may be inevitably adversely affected. It is difficult to determine some deficiencies of the external compensation line through pattern generation test, so the subsequent analysis may be adversely affected.

SUMMARY

In one aspect, the present disclosure provides in some embodiments a method for detecting a deficiency of an external compensation line for use in an external compensation pixel driving circuit connected to a data line, a power source voltage input end, a data write-in control end, an external compensation control end and the external compensation line. Each detection stage includes a resetting time period and a detection time period. The method includes steps of: within the resetting time period of each detection stage, applying a resetting voltage to the external compensation line and entering the detection time period after a resetting duration; and within the detection time period of each detection stage, controlling the external compensation line to be in a floating state, applying a data voltage to the data line, applying a power source voltage to the power source voltage input end, applying a data write-in control voltage to the data write-in control end, applying an external compensation control voltage to the external compensation control end, detecting a voltage across the external compensation line after a detection duration, and determining whether or not there is a short circuit for the external compensation line in accordance with the voltage across the external compensation line.

In a possible embodiment of the present disclosure, the method includes: within a resetting time period of a first detection stage, applying a first resetting voltage to the external compensation line, and entering a detection time period of the first detection stage after a first resetting duration; and within the detection time period of the first detection stage, controlling the external compensation line to be in the floating state, applying a first data write-in control voltage to the data write-in control end so as to turn off a data write-in transistor, applying a first external compensation control voltage to the external compensation control end so as to turn off an external compensation control transistor, applying a first voltage data to the data line, applying a first power source voltage to the power source voltage input end, detecting the voltage across the external compensation line after a first detection duration, determining that there is the short circuit between the external compensation line and the power source voltage input end in the case that an absolute value of a difference between the voltage across the external compensation line and the first power source voltage is smaller than a first voltage threshold, and determining that there is no short circuit between the external compensation line and the power source voltage input end in the case that the absolute value is greater than or equal to the first voltage threshold. An absolute value of a difference between the first data voltage and the first power source voltage is greater than a second voltage threshold, an absolute value of a difference between the first power source voltage and the first resetting voltage is greater than a third voltage threshold, an absolute value of a difference between the first data write-in control voltage and the first power source voltage is greater than a fourth voltage threshold, and an absolute value of a difference between the first external compensation control voltage and the first power source voltage is greater than a fifth voltage threshold.

In a possible embodiment of the present disclosure, in the case that there is no short circuit between the external compensation line and the power source voltage input end, the method further includes: within a resetting time period of a second detection stage, applying a second resetting voltage to the external compensation line, and entering a detection time period of the second detection stage after a second resetting duration; and within a detection time period of the second detection stage, controlling the external compensation line to be in the floating state, applying a second data write-in control voltage to the data write-in control end so as to turn on the data write-in transistor, applying a second external compensation control voltage to the external compensation control end so as to turn off the external compensation control transistor, applying a second data voltage to the data line so as to turned off a driving transistor, applying a second power source voltage to the power source voltage input end, detecting the voltage across the external compensation line after a second detection duration, determining that there is the short circuit between the external compensation line and the data write-in control end in the case that an absolute value of a difference between the voltage across the external compensation line and the second data write-in control voltage is smaller than a sixth voltage threshold, and determining that there is no short circuit between the external compensation line and the data write-in control end in the case that the absolute value is greater than or equal to the sixth voltage threshold. An absolute value of a difference between the second data voltage and the second data write-in control voltage is greater than a seventh voltage threshold, an absolute value of a difference between the second external compensation control voltage and the second data write-in control voltage is greater than an eighth voltage threshold, and an absolute value of a difference between the second data write-in control voltage and the second resetting voltage is greater than a ninth voltage threshold.

In a possible embodiment of the present disclosure, in the case that there is no short circuit between the external compensation line and the data write-in control end, the method further includes: within a resetting time period of a third detection stage, applying a third resetting voltage to the external compensation line, and entering a detection time period of the third detection stage after a third resetting duration; and within the detection time period of the third detection stage, controlling the external compensation line to be in the floating state, applying a third data write-in control voltage to the data write-in control end so as to turn on the data write-in transistor, applying a third external compensation control voltage to the external compensation control end so as to turn on the external compensation control transistor, applying a third data voltage to the data line so as to turn off the driving transistor, applying a third power source voltage to the power source voltage input end, detecting the voltage across the external compensation line after a third detection duration, determining that there is the short circuit between the external compensation line and the external compensation control end in the case that an absolute value of a difference between the voltage across the external compensation line and the third external compensation control voltage is smaller than a tenth voltage threshold, and determining that there is no short circuit between the external compensation line and the external compensation control end in the case that the absolute value greater than or equal to the tenth voltage threshold. An absolute value of a difference between the third data voltage and the third external compensation control voltage is greater than an eleventh voltage threshold, and an absolute value of a difference between the third external compensation control voltage and the third resetting voltage is greater than a twelfth voltage threshold.

In a possible embodiment of the present disclosure, the method further includes: within the detection time period of the third detection stage, comparing the detected voltage across the external compensation line with the third resetting voltage in the case that there is no short circuit between the external compensation line and the external compensation control end, determining that there is no short circuit between the external compensation control end and a second electrode of the driving transistor in the case that an absolute value of a difference between the voltage across the external compensation line and the third resetting voltage is smaller than a thirteenth voltage threshold, and determining that there is a short circuit between the external compensation control end and the second electrode of the driving transistor in the case that the absolute value is greater than or equal to the thirteenth voltage threshold.

In a possible embodiment of the present disclosure, in the case that there is no short circuit between the external compensation control end and the driving transistor, the method further includes: within a resetting time period of a fourth detection stage, applying a fourth resetting voltage to the external compensation line, and entering a detection time period of the fourth detection stage after a fourth resetting duration, an absolute value of a difference between the fourth resetting voltage and a low voltage applied to a low voltage input end being greater than a fourteenth voltage threshold; and within the detection time period of the fourth detection stage, controlling the external compensation line to be in the floating state, applying a fourth data write-in control voltage to the data write-in control end so as to turn off the data write-in transistor, applying a fourth external compensation control voltage to the external compensation control end so as to turn off the external compensation control transistor, applying a fourth data voltage to the data line so as to turn off the driving transistor, applying a fourth power source voltage to the power source voltage input end, detecting the voltage across the external compensation line after a fourth detection duration, determining that there is the short circuit between the external compensation line and the low voltage input end in the case that an absolute value of a difference between the voltage across the external compensation line and the low voltage is smaller than a fifteenth voltage threshold, and determining that there is no short circuit between the external compensation line and the low voltage input end in the case that the absolute value is greater than or equal to the fifteenth voltage threshold. An absolute value of a difference between the fourth data voltage and the fourth resetting voltage is smaller than a sixteenth voltage threshold.

In a possible embodiment of the present disclosure, in the case that there is not short circuit between the external compensation control end and the second electrode of the driving transistor, the method further includes: within a resetting time period of a fifth detection stage, applying a fifth resetting voltage to the external compensation line, and entering a detection time period of the fifth detection stage after a fifth resetting duration; and within the detection time period of the fifth detection stage, controlling the external compensation line to be in the floating state, applying a fifth data write-in control voltage to the data write-in control end so as to turn off the data write-in transistor, applying a fifth external compensation control voltage to the external compensation control end so as to turn off the external compensation control transistor, applying a fifth data voltage to the data line so as to turn on the driving transistor, applying a fifth power source voltage to the power source voltage input end, detecting the voltage across the external compensation line after a fifth detection duration, determining that there is the short circuit between the external compensation line and the data line in the case that an absolute value of a difference between the voltage across the external compensation line and the fifth data voltage is smaller than a seventeenth voltage threshold; and determining that there is no short circuit between the external compensation line and the data line in the case that the absolute value is greater than or equal to the seventeenth voltage threshold. An absolute value of a difference between the fifth data voltage and the fifth resetting voltage is greater than an eighteenth voltage threshold.

In another aspect, the present disclosure provides in some embodiments a device for detecting a deficiency of an external compensation line for use in an external compensation pixel driving circuit connected to a data line, a power source voltage input end, a data write-in control end, an external compensation control end and the external compensation line. The device includes: a resetting circuit configured to, within a resetting time period of each detection stage, apply a resetting voltage to the external compensation line; a floating-state control circuit configured to, within a detection time period of each detection stage, control the external compensation line to be in a floating state; a voltage application circuit configured to, within the detection time period of the detection stage, apply a data voltage to the data line, apply a power source voltage to the power source voltage input end, apply a data write-in control voltage to the data write-in control end, apply an external compensation control voltage to the external compensation control end, and transmit a detection control signal to a voltage detection circuit after a detection duration; the voltage detection circuit configured to detect a voltage across the external compensation line upon the receipt of the detection control signal; and a deficiency detection circuit configured to determine whether or not there is a short circuit for the external compensation line in accordance with the voltage across the external compensation line.

In yet another aspect, the present disclosure provides in some embodiments a display module including an external compensation pixel driving circuit and the above-mentioned device for detecting a deficiency of an external compensation line.

In a possible embodiment of the present disclosure, the external compensation pixel driving circuit includes: a data write-in transistor, a gate electrode of which is connected to data write-in control end, a first electrode of which is connected to a data line; a driving transistor, a gate electrode of which is connected to a second electrode of the data write-in transistor, a first electrode of which is connected to a power source voltage input end, and a second electrode of which is connected to a first electrode of a light-emitting element; a storage capacitor, a first end of which is connected to the gate electrode of the driving transistor and a second end of which is connected to the second electrode of the driving transistor; and an external compensation control transistor, a gate electrode of which is connected to an external compensation control end, a first electrode of which is connected to the first electrode of the driving transistor, and a second electrode of which is connected to the external compensation line. A second electrode of the light-emitting element is connected to a low level input end.

According to the method, the device and the display module in the embodiments of the present disclosure, with respect to the deficiencies of the external compensation line, the resetting voltage is applied to the external compensation line within the resetting time period of each detection stage, the external compensation line is controlled to be in the floating state within the detection time period of the detection stage after the resetting duration, the corresponding voltages are applied to the data line, the power source voltage input end, the data write-in control end and the external compensation control end respectively, and then the voltage across the external compensation line is detected after the detection duration. As a result, it is able to determine whether or not there is the short circuit for the external compensation line in accordance with the voltage across the external compensation line, and improve a manufacture process and optimize a compensation process in accordance with a detection result, thereby to improve the yield of the product.

DETAILED DESCRIPTION

Figure 1:
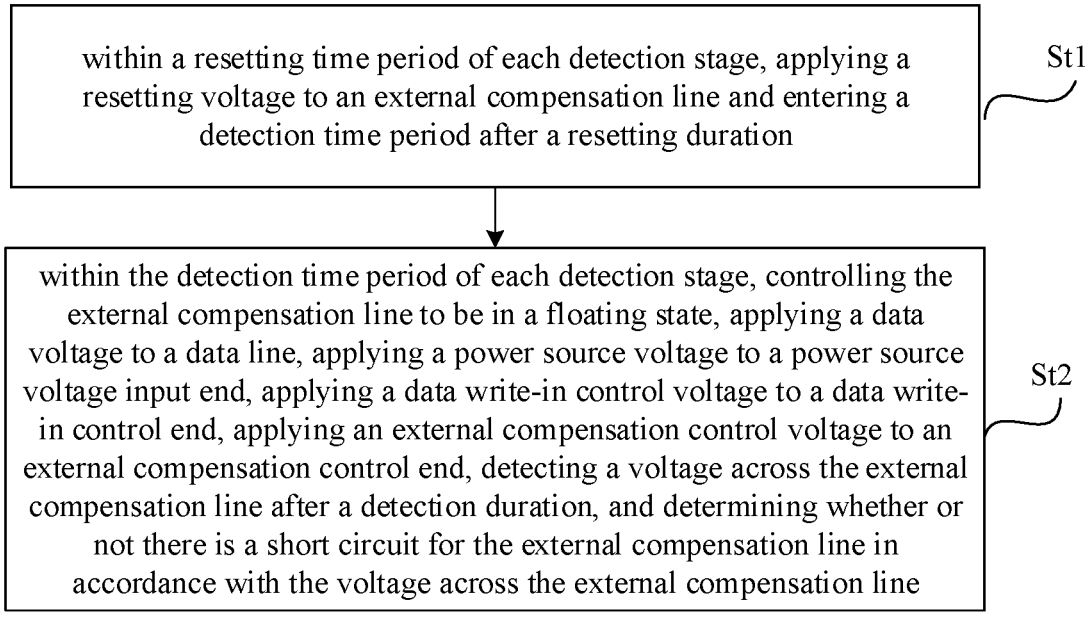
FIG. 1 is a flow chart of a method for detecting a deficiency of an external compensation line according to one embodiment of the present disclosure.

In order to make the objects, the technical solutions and the advantages of the present disclosure more apparent, the present disclosure will be described hereinafter in a clear and complete manner in conjunction with the drawings and embodiments. Obviously, the following embodiments merely relate to a part of, rather than all of, the embodiments of the present disclosure, and based on these embodiments, a person skilled in the art may, without any creative effort, obtain the other embodiments, which also fall within the scope of the present disclosure.

Unless otherwise defined, any technical or scientific term used herein shall have the common meaning understood by a person of ordinary skills. Such words as "first" and "second" used in the specification and claims are merely used to differentiate different components rather than to represent any order, number or importance. Similarly, such words as "one" or "one of" are merely used to represent the existence of at least one member, rather than to limit the number thereof. Such words as "connect" or "connected to" may include electrical connection, direct or indirect, rather than to be limited to physical or mechanical connection. Such words as "on", "under", "left" and "right" are merely used to represent relative position relationship, and when an absolute position of the object is changed, the relative position relationship will be changed too.

During the manufacture of an OLED display panel, in the case that a short circuit occurs for an external compensation line, a compensation effect of pixels in a column may be inevitably adversely affected, and it is difficult to determine some deficiencies of the external compensation line through pattern generation test.

The present disclosure provides in some embodiments a method for detecting a deficiency of an external compensation line for use in an external compensation pixel driving circuit connected to a data line, a power source voltage input end, a data write-in control end, an external compensation control end and the external compensation line. Each detection stage includes a resetting time period and a detection time period. The method includes steps of: St1 of, within the resetting time period of each detection stage, applying a resetting voltage to the external compensation line and entering the detection time period after a resetting duration; and St2 of, within the detection time period of each detection stage, controlling the external compensation line to be in a floating state, applying a data voltage to the data line, applying a power source voltage to the power source voltage input end, applying a data write-in control voltage to the data write-in control end, applying an external compensation control voltage to the external compensation control end, detecting a voltage across the external compensation line after a detection duration, and determining whether or not there is a short circuit for the external compensation line in accordance with the voltage across the external compensation line.

According to the method in the embodiments of the present disclosure, with respect to the deficiencies of the external compensation line, the resetting voltage is applied to the external compensation line within the resetting time period of each detection stage, the external compensation line is controlled to be in the floating state within the detection time period of the detection stage after the resetting duration, the corresponding voltages are applied to the data line, the power source voltage input end, the data write-in control end and the external compensation control end respectively, and then the voltage across the external compensation line is detected after the detection duration. As a result, it is able to determine whether or not there is the short circuit for the external compensation line in accordance with the voltage across the external compensation line, and improve a manufacture process and optimize a compensation process in accordance with a detection result, thereby to improve the yield of the product.

Figure 2:
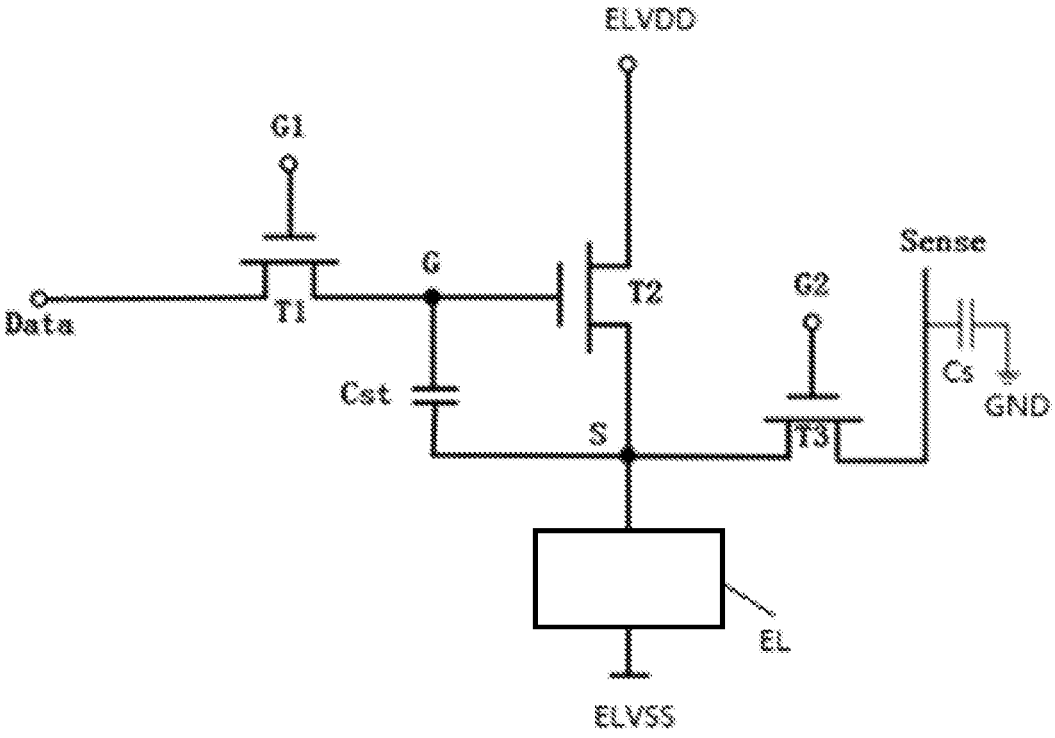
FIG. 2 is a circuit diagram of an external compensation pixel driving circuit to which the method is applied according to one embodiment of the present disclosure.

As shown in FIG. 2, the external compensation pixel driving circuit includes: a data write-in transistor T1, a gate electrode of which is connected to the data write-in control end G1, and source electrode of which is connected to the data line Data; a driving transistor T2, a gate electrode G of which is connected to a drain electrode of the data write-in transistor T1, a drain electrode of which is connected to the power source voltage input end ELVDD, and a source electrode S of which is connected to a first electrode of a light-emitting element EL; a storage capacitor Cst, a first end of which is connected to the gate electrode G of the driving transistor T2, and a second end of which is connected to the source electrode S of the driving transistor T2; and an external compensation control transistor T3, a gate electrode of which his connected to the external compensation control end G2, a source electrode of which is connected to the source electrode S2 of the driving transistor T2, and a drain electrode of which is connected to the external compensation line Sense. A second electrode of the light-emitting element EL is connected to a low level input end ELVSS.

In a possible embodiment of the present disclosure, the EL may be an OLED, the first electrode thereof may be an anode, and the second electrode thereof may be a cathode.

In a possible embodiment of the present disclosure, all the transistors in FIG. 2 may be n-type transistors. Of course, these transistors may also be p-type transistors, as long as control signals applied to the gate electrodes of the transistors are changed correspondingly.

In a possible embodiment of the present disclosure, as shown in FIG. 2, the external compensation line Sense is provided with a capacitor Cs, where GND represents a ground end. Due to the Cs, in the case that the voltage has been applied to Sense, it is necessary to charge Cs after a certain duration, so as to pull up the voltage across Sense. Hence, it is necessary to set a resetting duration and a detection duration.

In a possible embodiment of the present disclosure, five patterns are designed for the method in the embodiments of the present disclosure, so as to detect six different deficiencies, i.e., a short circuit between Sense and ELVDD, a short circuit between Sense and G1, a short circuit between Sense and G2, a short circuit between G2 and S, a short circuit between Sense and ELVSS, and a short circuit between Sense and Data. The steps for detecting the deficiency will be described hereinafter in more details.

Usually, an analog-to-digital converter (ADC) is used to detect the voltage across the external compensation line Sense. In the case that the voltage detected by the ADC is too large, the ADC may be burned out. In the embodiments of the present disclosure, in the case that the external compensation pixel driving circuit operates normally, the power source voltage applied to ELVDD is 24V. In order to prevent the ADC from being burned out due to the short circuit between Sense and ELVDD, it is necessary to detect at first whether or not there is the short circuit between Sense and ELVDD.

In a possible embodiment of the present disclosure, the method specifically includes: within a resetting time period of a first detection stage, applying a first resetting voltage to the external compensation line, and entering a detection time period of the first detection stage after a first resetting duration; and within the detection time period of the first detection stage, controlling the external compensation line to be in the floating state, applying a first data write-in control voltage to the data write-in control end so as to turn off the data write-in transistor, applying a first external compensation control voltage to the external compensation control end so as to turn off the external compensation control transistor, applying a first voltage data to the data line, applying a first power source voltage to the power source voltage input end, detecting the voltage across the external compensation line after a first detection duration, determining that there is the short circuit between the external compensation line and the power source voltage input end in the case that an absolute value of a difference between the voltage across the external compensation line and the first power source voltage is smaller than a first voltage threshold, and determining that there is no short circuit between the external compensation line and the power source voltage input end in the case that the absolute value is greater than or equal to the first voltage threshold. An absolute value of a difference between the first data voltage and the first power source voltage is greater than a second voltage threshold, an absolute value of a difference between the first power source voltage and the first resetting voltage is greater than a third voltage threshold, an absolute value of a difference between the first data write-in control voltage and the first power source voltage is greater than a fourth voltage threshold, and an absolute value of a difference between the first external compensation control voltage and the first power source voltage is greater than a fifth voltage threshold.

Figure 3:
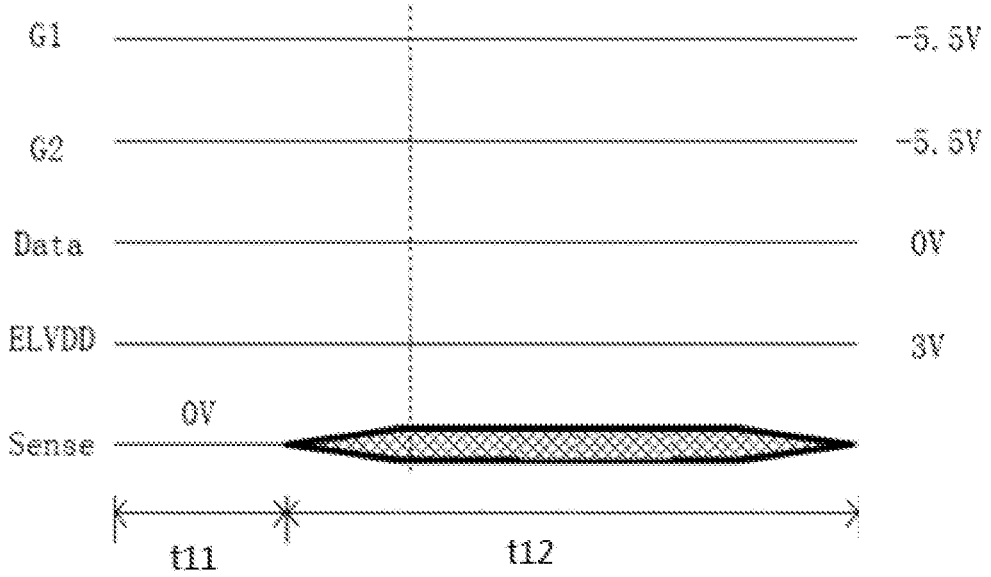
FIG. 3 is an oscillogram of voltages applied to signal lines and signal ends in the case of determining whether or not there is a short circuit between the external compensation line and a power source voltage input end according to one embodiment of the present disclosure.

In a possible embodiment of the present disclosure, as shown in FIG. 3, within the first resetting time period t11 of the first detection stage, the first resetting voltage applied to Sense may be 0V. Within the first detection time period t12 of the first detection stage, Sense may be controlled to be in the floating state. In FIG. 3, the first resetting duration may be 10 μs, the first detection duration may be 4 μs to 6 μs, and the voltage across Sense may be detected at a position indicated by a dotted line. As shown in FIG. 3, the first data write-in control voltage applied to G1 may be −5.5V and the first external compensation control voltage applied to G2 may be −5.5V, so as to turn off T1 and T3. The first data voltage applied to Data may be 0V, and the first power source voltage applied to ELVDD may be 3V, so as to turn off T2 too. In the case that there is the short circuit between Sense and ELVDD, the detected voltage across Sense shall approach to 3V, i.e., the absolute value of the difference between the voltage across Sense and 3V shall be smaller than the first voltage threshold. The first voltage threshold may be set in accordance with the practical need (e.g., in accordance with a value of the first power source voltage). Usually, the first voltage threshold shall be set as relatively small, e.g., 0.5V. In order to determine whether or not there is the short circuit between Sense and ELVDD, it is necessary to provide a relatively large difference between the first resetting voltage and the first power source voltage, i.e., the absolute value of the difference between the first power source voltage and the first resetting voltage needs to be greater than the third voltage threshold. The third voltage threshold may be set in accordance with the practical need, e.g., 2V. In the case that there is no short circuit between Sense and ELVDD, the short circuit may probably exist between Sense and any other signal line or signal end. In order to determine whether the short circuit exists between Sense and ELVDD or between Sense and any other signal line or signal end, it is necessary to provide a relatively large difference between the first data voltage and the first power source voltage, a relatively large difference between the first data write-in control voltage and the first power source voltage, and a relatively large difference between the first external compensation control voltage and the first power source voltage. In other words, the absolute value of the difference between the first data voltage and the first power source voltage needs to be greater than the second voltage threshold, the absolute value of the difference between the first data write-in control voltage and the first power source voltage needs to be greater than the fourth voltage threshold, and the absolute value of the difference between the first external compensation control voltage and the first power source voltage needs to be greater than the fifth voltage threshold. The second voltage threshold, the fourth voltage threshold and the fifth voltage threshold may be set in accordance with the practical need. For example, the second voltage threshold may be 2V, and the fourth voltage threshold and the fifth voltage threshold may each be 6V.

In the embodiments of the present disclosure, usually the so-called relatively small voltage difference is not greater than 1V, e.g., 0V, 0.2V, 0.5V or 1V, and the so-called relatively large voltage difference is not smaller than 3V, e.g., 3V, 5V, 8V, 10V or 12V.

In FIG. 3, grids represent that Sense is in the floating state.

Figure 4:
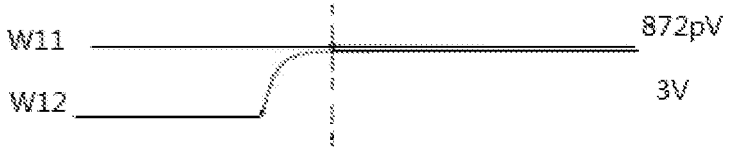
FIG. 4 is a schematic view showing an experimental result of a voltage applied to the external compensation line Sense in the case that the voltages are applied to the signal lines and the signal ends of the external compensation pixel driving circuit in FIG. 3.

In FIG. 4, after the corresponding voltages have been applied to the signal lines and the signal ends, W11 shows a waveform of the voltage across Sense in the case that there is no short circuit for Sense (in W11, the voltage across Sense is 872 pV, i.e., it approaches to 0), and W12 shows a waveform of the voltage across Sense in the case that there is the short circuit between Sense and ELVDD (in W12, the voltage across Sense is 3V), where the dotted line shows a position where the voltage across Sense is detected.

Through determining whether or not there is the short circuit between the external compensation line Sense and the power source input end ELVDD, it is able to prevent an integrated circuit (IC) on a chip on film (COF) from being damaged. During the normal display, the power source voltage applied to ELVDD is usually 24V, and in the case that there is the short circuit between Sense and ELVDD, the voltage across Sense may be always maintained as about 24V. At this time, incorrect data may be outputted from Sense at a COF region where the deficiency occurs, and there may exist a risk of being damaged for the IC on the COF.

In a possible embodiment of the present disclosure, in the case that there is the short circuit between the external compensation line and the power source voltage input end, the short circuits between Sense and the other signal lines or signal ends may be, or may not be, detected subsequently.

For G2, it is necessary to determine whether or not there is the short circuit between Sense and G2 and determine whether or not there is the short circuit between G2 and the source electrode S of the driving transistor. Hence, whether or not there is the short circuit between Sense and G1 needs to be determined at first.

In a possible embodiment of the present disclosure, in the case that there is no short circuit between the external compensation line and the power source voltage input end, the method further includes: within a resetting time period of a second detection stage subsequent to the first detection stage, applying a second resetting voltage to the external compensation line, and entering a detection time period of the second detection stage after a second resetting duration; and within a detection time period of the second detection stage, controlling the external compensation line to be in the floating state, applying a second data write-in control voltage to the data write-in control end so as to turn on the data write-in transistor, applying a second external compensation control voltage to the external compensation control end so as to turn off the external compensation control transistor, applying a second data voltage to the data line so as to turned off the driving transistor, applying a second power source voltage to the power source voltage input end, detecting the voltage across the external compensation line after a second detection duration, determining that there is the short circuit between the external compensation line and the data write-in control end in the case that an absolute value of a difference between the voltage across the external compensation line and the second data write-in control voltage is smaller than a sixth voltage threshold, and determining that there is no short circuit between the external compensation line and the data write-in control end in the case that the absolute value is greater than or equal to the sixth voltage threshold. An absolute value of a difference between the second data voltage and the second data write-in control voltage is greater than a seventh voltage threshold, an absolute value of a difference between the second external compensation control voltage and the second data write-in control voltage is greater than an eighth voltage threshold, and an absolute value of a difference between the second data write-in control voltage and the second resetting voltage is greater than a ninth voltage threshold.

Figure 5:
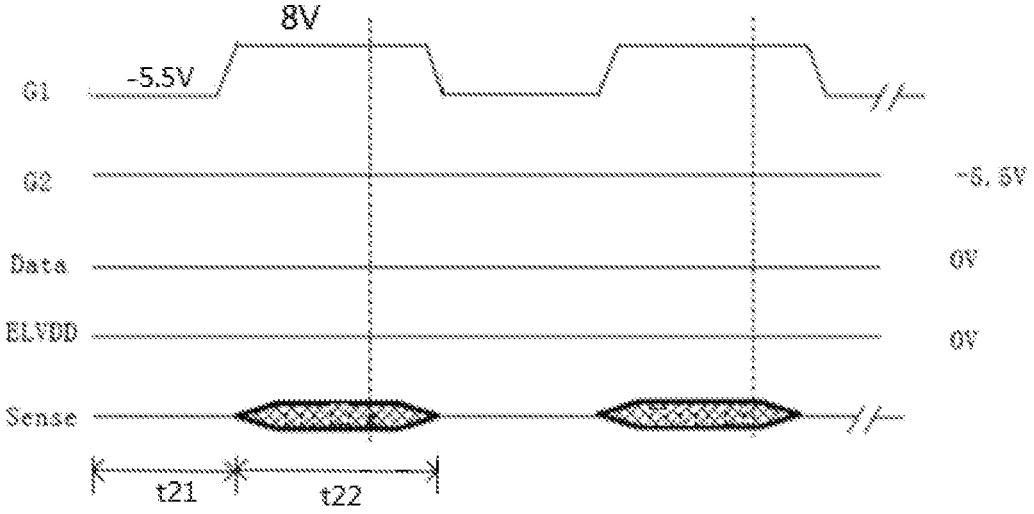
FIG. 5 is an oscillogram of the voltages applied to the signal lines and the signal ends in the case of determining whether or not there is a short circuit between the external compensation line and a data write-in control end according to one embodiment of the present disclosure.

In a possible embodiment of the present disclosure, as shown in FIG. 5, within the second resetting time period t21 of the second detection stage, the second resetting voltage applied to Sense may be 0V, the voltage applied to G1 may be −5.5V so as to turn off T1, the voltage applied to G2 may be −5.5V so as to turn off T3, and the voltage applied to Data may be 0V so as to turn off T2. Within the second detection time period t22 of the second detection stage, Sense may be controlled to be in the floating state. In FIG. 5, the second resetting duration may be 10 μs, the second detection duration may be 4 μs to 6 μs, and the voltage across Sense may be detected at a position indicated by a dotted line. Within the second detection time period, the second data write-in control voltage applied to G1 may be 8V so as to turn on T1. The second external compensation control voltage applied to G2 may be −5.5V so as to turn off T3. The second data voltage applied to Data maybe 0V, and the first power source voltage applied to ELVDD may be 0V so as to turn off T2. In the case that there is the short circuit between Sense and G1, the detected voltage across Sense shall approach to 8V (at this time, the voltage across Sense may be detected by the ADC), i.e., the absolute value of the difference between the voltage across Sense and 8V shall be smaller than the sixth voltage threshold. The sixth voltage threshold may be set in accordance with the practical need (e.g., in accordance with the difference between the second data write-in control voltage and the second resetting voltage). Usually, the sixth voltage threshold shall be relatively small, e.g., 1V In order to determine whether or not there is the short circuit between Sense and G1, it is necessary to provide a relatively large difference between the second resetting voltage and the second data write-in control voltage, i.e., the absolute value of the difference between the second data write-in control voltage and the second resetting voltage needs to be greater than the ninth voltage threshold. The ninth voltage threshold may be set in accordance with the practical need, e.g., 3V. In the case that there is no short circuit between Sense and G1, the short circuit may probably exist between Sense and any other signal line or signal end (not including the power source voltage input end). In order to differentiate whether or not the short circuit exists between Sense and G1 or between Sense and the other signal lien or signal end, it is necessary to provide a relatively large difference between the second data voltage and the second data write-in control voltage, and provide a relatively large difference between the second external compensation control voltage and the second data write-in control voltage. In other words, the absolute value of the difference between the second data voltage and the second data write-in control voltage needs to be greater than the seventh voltage threshold, and the absolute value of the difference between the second data write-in control voltage and the second external control voltage needs to be greater than the eighth voltage threshold. The seventh voltage threshold and the eighth voltage threshold may be set in accordance with the practical need. For example, the seventh voltage threshold may be 3V, and the eighth voltage threshold may be 5V.

The voltage across the external compensation line Sense may be detected by the ADC. Usually, a maximum allowable voltage applied to the ADC (i.e., a maximum operating voltage of the ADC) is 8V, and in the case that the voltage exceeds 8V, the ADC may be damaged. Hence, in the embodiments of the present disclosure, a value of a high level may be adjusted in accordance with the maximum allowable voltage applied to the ADC. Within the range of the operating voltage of the ADC, a large charge rate may be provided in the case that a high voltage is applied. Here, the high level may be adjusted in accordance with the practical need.

In a possible embodiment of the present disclosure, in the case that the detection duration is relatively long, i.e., a charging time period is sufficiently long, the smaller second data write-in control voltage may be applied to G1. For example, the second data write-in control voltage may be 3V or 5V. In FIG. 5, the duration within which the data write-in control voltage is maintained as 8V may be 17 μs, and the grids represent that Sense is in the floating state.

Figure 6:
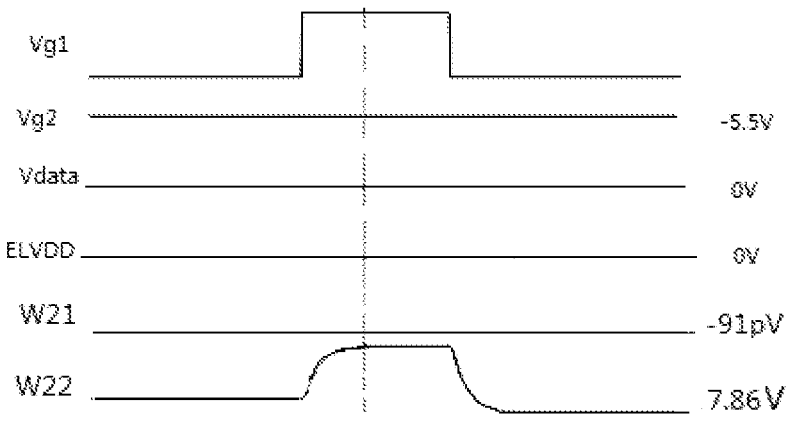
FIG. 6 is a schematic view showing an experimental result of the voltage applied to the external compensation line Sense in the case that the voltages are applied to the signal lines and the signal ends of the external compensation pixel driving circuit in FIG. 5.

In FIG. 6, after the corresponding voltages have been applied to the signal lines and the signal ends, W21 shows a waveform of the voltage across Sense in the case that there is no short circuit for Sense (in W21, the voltage across Sense is −91 pV, i.e., it approaches to 0), and W22 shows a waveform of the voltage across Sense in the case that there is the short circuit between Sense and D1 (in W22, the voltage across Sense is 7.86V, i.e., it approaches to 8V), where the dotted line shows a position where the voltage across Sense is detected.

FIG. 6 also shows the voltage Vg1 applied to G1, the voltage Vg2 applied to G2, the voltage Vdata applied to the data line Data, and the voltage applied to the power source voltage input end ELVDD.

In a possible embodiment of the present disclosure, in the case that there is the short circuit between the external compensation line and the data write-in control end G1, the short circuits between Sense and the other signal lines or signal ends may be, or may not be, detected subsequently.

To be specific, in the case that there is no short circuit between the external compensation line and the data write-in control end, the method further includes: within a resetting time period of a third detection stage subsequent to the second detection stage, applying a third resetting voltage to the external compensation line, and entering a detection time period of the third detection stage after a third resetting duration; and within the detection time period of the third detection stage, controlling the external compensation line to be in the floating state, applying a third data write-in control voltage to the data write-in control end so as to turn on the data write-in transistor, applying a third external compensation control voltage to the external compensation control end so as to turn on the external compensation control transistor, applying a third data voltage to the data line so as to turn off the driving transistor, applying a third power source voltage to the power source voltage input end, detecting the voltage across the external compensation line after a third detection duration, determining that there is the short circuit between the external compensation line and the external compensation control end in the case that an absolute value of a difference between the voltage across the external compensation line and the third external compensation control voltage is smaller than a tenth voltage threshold, and determining that there is no short circuit between the external compensation line and the external compensation control end in the case that the absolute value greater than or equal to the tenth voltage threshold. An absolute value of a difference between the third data voltage and the third external compensation control voltage is greater than an eleventh voltage threshold, and an absolute value of a difference between the third external compensation control voltage and the third resetting voltage is greater than a twelfth voltage threshold.

To be specific, the method further includes, within the detection time period of the third detection stage, comparing the detected voltage across the external compensation line with the third resetting voltage in the case that there is no short circuit between the external compensation line and the external compensation control end, determining that there is no short circuit between the external compensation control end and the second electrode of the driving transistor in the case that an absolute value of a difference between the voltage across the external compensation line and the third resetting voltage is smaller than a thirteenth voltage threshold, and determining that there is a short circuit between the external compensation control end and the second electrode of the driving transistor in the case that the absolute value is greater than or equal to the thirteenth voltage threshold.

Figure 7:
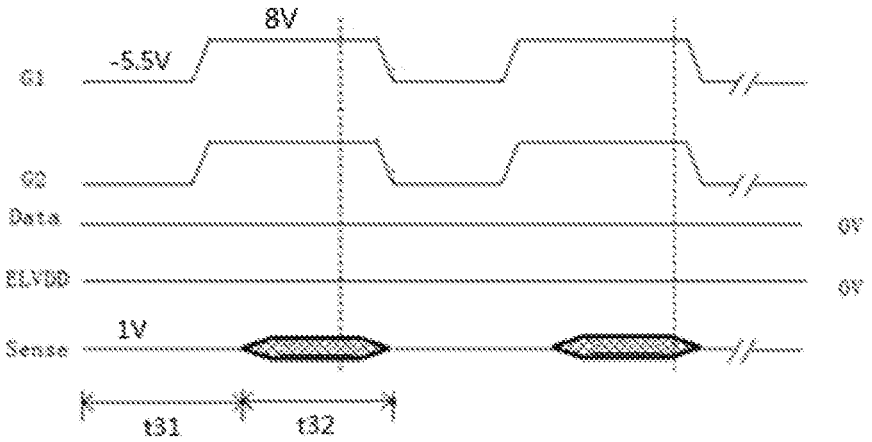
FIG. 7 is an oscillogram of the voltages applied to the signal lines and the signal ends in the case of determining whether or not there is a short circuit between the external compensation line and an external compensation control end according to one embodiment of the present disclosure.

In a possible embodiment of the present disclosure, as shown in FIG. 7, within the third resetting time period t31 of the third detection stage, the third resetting voltage applied to Sense may be 1V. Within a duration of 10 μs from the beginning of t31, the voltage applied to G1 may be −5.5V so as to turn off T1, the voltage applied to G2 may be −5.5V so as to turn off T3, and the voltage applied to Data may be 0V, so as to turn off T2. Within a duration from 10 μs to 13 μs, the voltage applied to G1 may be 8V, and the voltage applied to G2 may be increased to 8V from −5.5V. Within the third detection time period t32 of the third detection stage, Sense may be controlled to be in the floating state. In FIG. 7, the third resetting duration maybe 13 μs, the third detection duration may be 15 μs to 16 μs, and the voltage across Sense may be detected at a position indicated by a dotted line. Within the third detection time period t32, the third voltage write-in control voltage applied to G1 may be 8V so as to turn on T1, the third external compensation control voltage applied to G2 may be 8V so as to turn on T3, the third data voltage applied to Data may be 0V, and the third power source voltage applied to ELVDD may be 0V so as to turn off T2. In the case that there is the short circuit between Sense and G2 (at this time, there is not short circuit between Sense and G1), the detected voltage across Sense shall approach to 8V (at this time, the voltage across Sense is detected by a voltage detection element other than the ADC), i.e., the absolute value of the difference between the voltage across Sense and 8V shall be smaller than the tenth voltage threshold. The tenth voltage threshold may be set in accordance with the practical need (e.g., in accordance with the difference between the third external compensation control voltage and the third resetting voltage). Usually, the tenth voltage threshold shall be relatively small, e.g., 1V. In order to determine whether or not there is the short circuit between Sense and G2, it is necessary to provide a relatively large difference between the third resetting voltage and the third external compensation control voltage, i.e., the absolute value of the difference between the third external compensation control voltage and the third resetting voltage needs to be greater than the twelfth voltage threshold. The twelfth voltage threshold may be 4V. In the case that there is no short circuit between Sense and G2, the short circuit may probably exist between Sense and the data line. In order to differentiate whether the short circuit exists between Sense and G1 or between Sense and the data line, it is necessary to provide a relatively large difference between the third data voltage and the third external compensation control voltage, i.e., the absolute value of the difference between the third data voltage and the third external compensation control voltage needs to be greater than the eleventh voltage threshold. The eleventh voltage threshold may be set in accordance with the practical need, e.g., 5V.

In a possible embodiment of present disclosure, in the case that the detection duration is relatively long, i.e., a charging time period is sufficiently long, the smaller third data write-in control voltage may be applied to G1, and the smaller third external compensation control voltage may be applied to G2 too. For example, the third data write-in control voltage may be 3V or 5V, and the third external compensation control voltage may be 3V or 5V. In FIG. 7, the duration of t32 may be 17 μs, the duration within which the data write-in control voltage is maintained as 8V may be 17 μs, the duration within which the external compensation control voltage is maintained as 8V may be 17 μs, and the grids represent that Sense is in the floating state.

Figure 8:
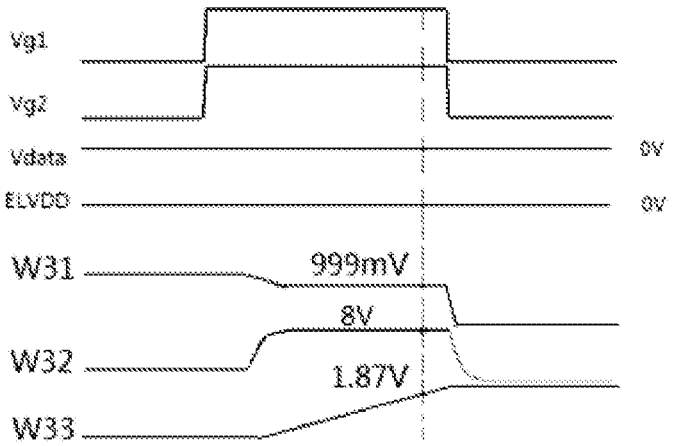
FIG. 8 is a schematic view showing an experimental result of the voltage applied to the external compensation line Sense in the case that the voltages are applied to the signal lines and the signal ends of the external compensation pixel driving circuit in FIG. 7.

In FIG. 8, after the corresponding voltages have been applied to the signal lines and the signal ends, W31 shows a waveform of the voltage across Sense in the case that there is no short circuit for Sense (in W31, the voltage across Sense is 999 mV, i.e., it approaches to 0), and W32 shows a waveform of the voltage across Sense in the case that there is the short circuit between Sense and G2 (in W32, the voltage across Sense approaches to 8V), where the dotted line shows a position where the voltage across Sense is detected.

FIG. 8 also shows the voltage Vg1 applied to G1, the voltage Vg2 applied to G2, the voltage Vdata applied to the data line Data, and the voltage applied to the power source voltage input end ELVDD.

Within the detection time period of the third detection stage, in the case that there is no short circuit between the external compensation line Sense and the external compensation control end G2, the detected voltage across the external compensation line Sense may be compared with the third resetting voltage (which may be, e.g., 1V). In the case that the absolute value of the difference between the voltage across the external compensation line Sense and the third resetting voltage is smaller than the thirteenth voltage threshold, there is no short circuit between the external compensation control end G2 and the source electrode S of the driving transistor. In the case that the absolute value is greater than or equal to the thirteenth voltage difference, there is the short circuit between the external compensation control end G2 and the source electrode S of the driving transistor. The thirteenth voltage threshold may be set in accordance with the practical need (i.e., in accordance with a value of the third resetting voltage), e.g., 0.2V.

In a possible embodiment of the present disclosure, in the case that there is the short circuit between G2 and S (at this time, there is no short circuit between Sense and ELVDD, between Sense and G1 and between Sense and G2), T3 is in the form of a diode, the source electrode of which is equivalent to an anode and the drain electrode of which is equivalent to a cathode. At the third detection stage, the capacitor Cs on Sense may be charged, so the voltage across Sense may increase. As shown in FIG. 8, after the corresponding voltages have been applied to the signal lines and the signal ends, W33 shows a waveform of the voltage across Sense in the case that there is the short circuit between G2 and S (in W33, the voltage across Sense is 1.87V, and a difference between 1.87V and the third resetting voltage (e.g., 1V) is greater than the thirteenth voltage threshold (e.g., 0.2V)), where the dotted line shows a position where the voltage across Sense is detected.

To be specific, in the case that there is no short circuit between the external compensation control end and the driving transistor, the method further includes: within a resetting time period of a fourth detection stage subsequent to the third detection stage, applying a fourth resetting voltage to the external compensation line, and entering a detection time period of the fourth detection stage after a fourth resetting duration, an absolute value of a difference between the fourth resetting voltage and a low voltage applied to a low voltage input end being greater than a fourteenth voltage threshold; and within the detection time period of the fourth detection stage, controlling the external compensation line to be in the floating state, applying a fourth data write-in control voltage to the data write-in control end so as to turn off the data write-in transistor, applying a fourth external compensation control voltage to the external compensation control end so as to turn off the external compensation control transistor, applying a fourth data voltage to the data line so as to turn off the driving transistor, applying a fourth power source voltage to the power source voltage input end, detecting the voltage across the external compensation line after a fourth detection duration, determining that there is the short circuit between the external compensation line and the low voltage input end in the case that an absolute value of a difference between the voltage across the external compensation line and the low voltage is smaller than a fifteenth voltage threshold, and determining that there is no short circuit between the external compensation line and the low voltage input end in the case that the absolute value is greater than or equal to the fifteenth voltage threshold. An absolute value of a difference between the fourth data voltage and the fourth resetting voltage is smaller than a sixteenth voltage threshold.

Figure 9:
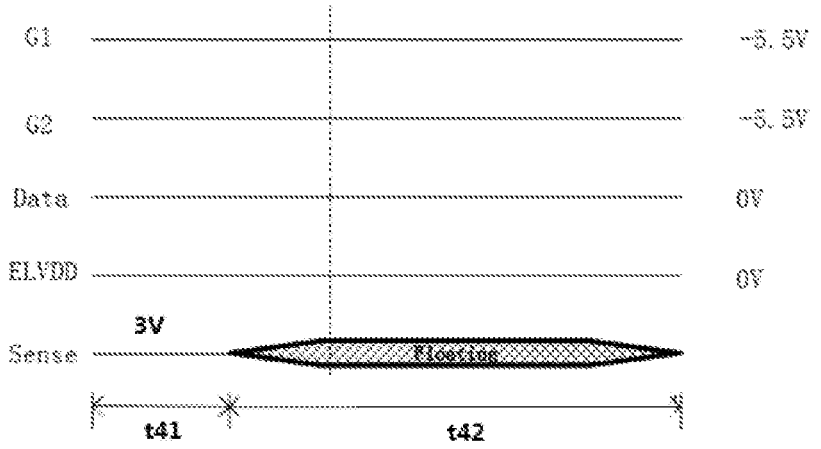
FIG. 9 is an oscillogram of the voltages applied to the signal lines and the signal ends in the case of determining whether or not there is a short circuit between the external compensation line and a low voltage input end according to one embodiment of the present disclosure.
Figure 10:
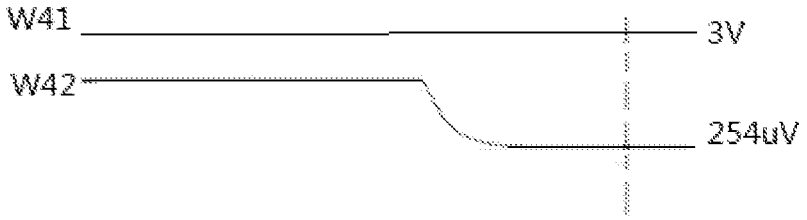
FIG. 10 is a schematic view showing an experimental result of the voltage applied to the external compensation line Sense in the case that the voltages are applied to the signal lines and the signal ends of the external compensation pixel driving circuit in FIG. 9.

In a possible embodiment of the present disclosure, as shown in FIG. 9, within the fourth resetting time period t41 of the fourth detection stage, the fourth resetting voltage applied to Sense may be 3V, the voltage applied to G1 may be −5.5V so as to turn off T1, the voltage applied to G2 may be −5.5V so as to turn off T3, and the voltage applied to Data may be 0V. Within the second detection time period t42 of the fourth detection stage, Sense may be controlled to be in the floating state. In FIG. 9, the fourth resetting duration may be 10 μs, the second detection duration may be 6 μs to 8 μs, and the voltage across Sense may be detected at a position indicated by a dotted line. Within the fourth detection time period, the fourth data write-in control voltage applied to G1 may be −5.5V so as to turn off T1. The fourth external compensation control voltage applied to G2 may be −5.5V so as to turn off T3. The fourth data voltage applied to Data may be 0V. The first power source voltage applied to ELVDD may be 0V so as to turn off T2. In the case that there is the short circuit between Sense and ELVSS, the detected voltage across Sense shall approach to 0V, i.e., the absolute value of the difference between the voltage across Sense and 0V shall be smaller than the fifteenth voltage threshold. The fifteenth voltage threshold may be set in accordance with the practical need. Usually, the fifteenth voltage threshold shall be relatively small, e.g., 0.5V. In order to determine whether or not there is the short circuit between Sense and ELVSS, it is necessary to provide a relatively large difference between the fourth resetting voltage and the low voltage applied to the low voltage input end, i.e., the absolute value of the difference between the fourth resetting voltage and the low voltage needs to be greater than the fourteenth voltage threshold. The fourteenth voltage threshold may be set in accordance with the practical need, e.g., 2V. In the case that there is no short circuit between Sense and ELVSS, the short circuit may probably exist between Sense and the data line Data. In order to differentiate whether the short circuit exists between Sense and ELVSS or between Sense and Data, it is necessary to provide a relatively large difference between the fourth data voltage and the fourth resetting voltage, i.e., the absolute value of the difference between the fourth data voltage and the fourth resetting voltage needs to be smaller than the sixteenth voltage threshold. The sixteenth voltage threshold may be set in accordance with the practical need, e.g., 2V. In FIG. 9, grids represent that Sense is in the floating state.

In FIG. 9, after the corresponding voltages have been applied to the signal lines and the signal ends, W41 shows a waveform of the voltage across Sense in the case that there is no short circuit for Sense (in W41, the voltage across Sense approaches to 3V), and W42 shows a waveform of the voltage across Sense in the case that there is the short circuit between Sense and ELVSS (in W42, the voltage across Sense is 254 μV, i.e., it approaches to 0V), where the dotted line shows a position where the voltage across Sense is detected.

In the case that there is the short circuit between Sense and ELVSS, the voltage across Sense is 0V, and at this time, it is impossible to compensate for the pixels in a current column corresponding to Sense normally. The voltage across Sense is pulled down by ELVSS, so an overcompensation effect and thereby a bright line may occur. Subsequently, it is able to optimize the compensation process, so as to prevent the occurrence of the overcompensation effect.

To be specific, in the case that there is not short circuit between the external compensation control end and the second electrode of the driving transistor, the method further includes: within a resetting time period of a fifth detection stage, applying a fifth resetting voltage to the external compensation line, and entering a detection time period of the fifth detection stage after a fifth resetting duration; and within the detection time period of the fifth detection stage, controlling the external compensation line to be in the floating state, applying a fifth data write-in control voltage to the data write-in control end so as to turn off the data write-in transistor, applying a fifth external compensation control voltage to the external compensation control end so as to turn off the external compensation control transistor, applying a fifth data voltage to the data line so as to turn on the driving transistor, applying a fifth power source voltage to the power source voltage input end, detecting the voltage across the external compensation line after a fifth detection duration, determining that there is the short circuit between the external compensation line and the data line in the case that an absolute value of a difference between the voltage across the external compensation line and the fifth data voltage is smaller than a seventeenth voltage threshold; and determining that there is no short circuit between the external compensation line and the data line in the case that the absolute value is greater than or equal to the seventeenth voltage threshold. An absolute value of a difference between the fifth data voltage and the fifth resetting voltage is greater than an eighteenth voltage threshold.

Figure 11:
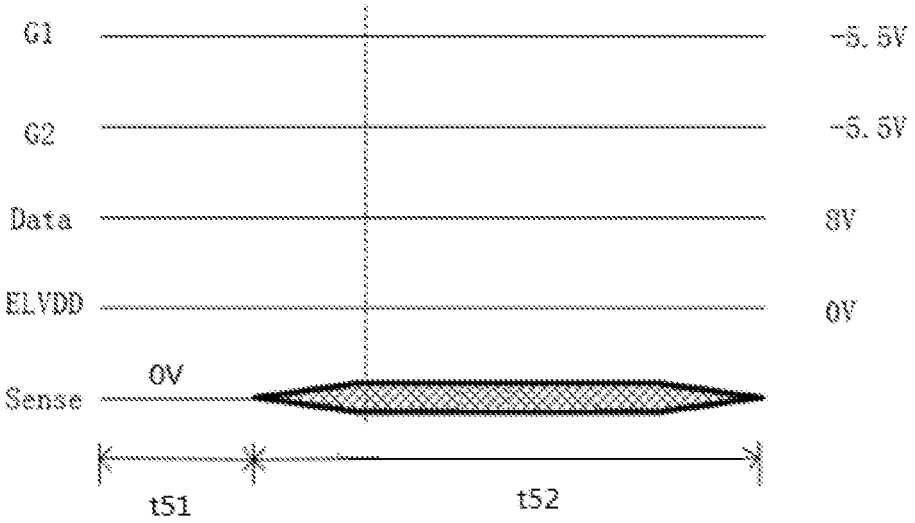
FIG. 11 is an oscillogram of the voltages applied to the signal lines and the signal ends in the case of determining whether or not there is a short circuit between the external compensation line and a data line according to one embodiment of the present disclosure.

In a possible embodiment of the present disclosure, as shown in FIG. 11, within the fifth resetting time period t51 of the fifth detection stage, the fifth resetting voltage applied to Sense may be 0V, the voltage applied to G1 may be −5.5V so as to turn off T1, the voltage applied to G2 may be −5.5V so as to turn off T3, and the voltage applied to Data may be 8V. Within the fifth detection time period t52 of the fifth detection stage, Sense may be controlled to be in the floating state. In FIG. 11, the fifth resetting duration may be 10 μs, the second detection duration may be 4 μs to 6 μs, and the voltage across Sense may be detected at a position indicated by a dotted line. Within the fifth detection time period T52, the fifth data write-in control voltage applied to G1 may be −5.5V so as to turn off T1. The fourth external compensation control voltage applied to G2 may be −5.5V so as to turn off T3. The fifth data voltage applied to Data may be 8V. The first power source voltage applied to ELVDD may be 0V so as to turn on T2. In the case that there is the short circuit between Sense and Data, the detected voltage across Sense shall approach to 8V, i.e., the absolute value of the difference between the voltage across Sense and 8V shall be smaller than the seventeenth voltage threshold. The seventeenth voltage threshold may be set in accordance with the practical need. Usually, the seventeenth voltage threshold shall be relatively small, e.g., 0.5V. In order to determine whether or not there is the short circuit between Sense and Data, it is necessary to provide a relatively large difference between the fifth data voltage and the fifth resetting voltage, i.e., the absolute value of the difference between the fifth data voltage and the fifth resetting voltage needs to be greater than the eighteenth voltage threshold. The eighteenth voltage threshold may be set in accordance with the practical need, e.g., 3V. In FIG. 11, grids represent that Sense is in the floating state.

Figure 12:
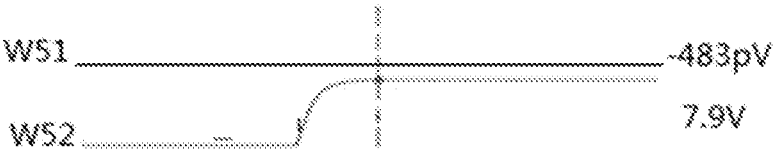
FIG. 12 is a schematic view showing an experimental result of the voltage applied to the external compensation line Sense in the case that the voltages are applied to the signal lines and the signal ends of the external compensation pixel driving circuit in FIG. 11.

In FIG. 12, after the corresponding voltages have been applied to the signal lines and the signal ends, W51 shows a waveform of the voltage across Sense in the case that there is no short circuit for Sense (in W51, the voltage across Sense is 7.9V, i.e., it approaches to 8V), and W52 shows a waveform of the voltage across Sense in the case that there is the short circuit between Sense and Data (in W52, the voltage across Sense is −483 pV, i.e., it approaches to 0V), where the dotted line shows a position where the voltage across Sense is detected.

In the embodiments of the present disclosure, the voltage thresholds (i.e., the first voltage threshold to the eighteenth voltage threshold) may each be a positive voltage threshold.

In the embodiments of the present disclosure, after the detection of the deficiency of the external compensation line Sense, a detection result may be stored in a register. Next, the detection result may be compared with the deficiency, so as to determine the type, the number and the positions of the deficiencies. Then, a map may be created on the basis of the detected data using Matlab. In this way, it is able to observe the yield of the product intuitively. In addition, it is able to perform the analysis in accordance with the data as well as such factors as the manufacture process and the manufacture device, thereby to improve the manufacture process and the yield.

In a possible embodiment of the present disclosure, the voltages may be applied to the signal lines and the signal ends connected to the external compensation pixel driving circuit in the following order. At the first detection stage, the voltages in FIG. 3 may be applied to the signal lines and the signal ends. At the second detection stage, the voltages in FIG. 5 may be applied to the signal lines and the signal ends. At the third detection stage, the voltages in FIG. 7 may be applied to the signal lines and the signal ends. At the fourth detection stage, the voltages in FIG. 9 may be applied to the signal lines and the signal ends. At the fifth detection stage, the voltages in FIG. 11 may be applied to the signal lines and the signal ends.

In a possible embodiment of the present disclosure, the first detection stage, the second detection stage, the third detection stage, the fourth detection stage and the fifth detection stage may be performed sequentially, so as to detect the deficiencies.

Figure 13:
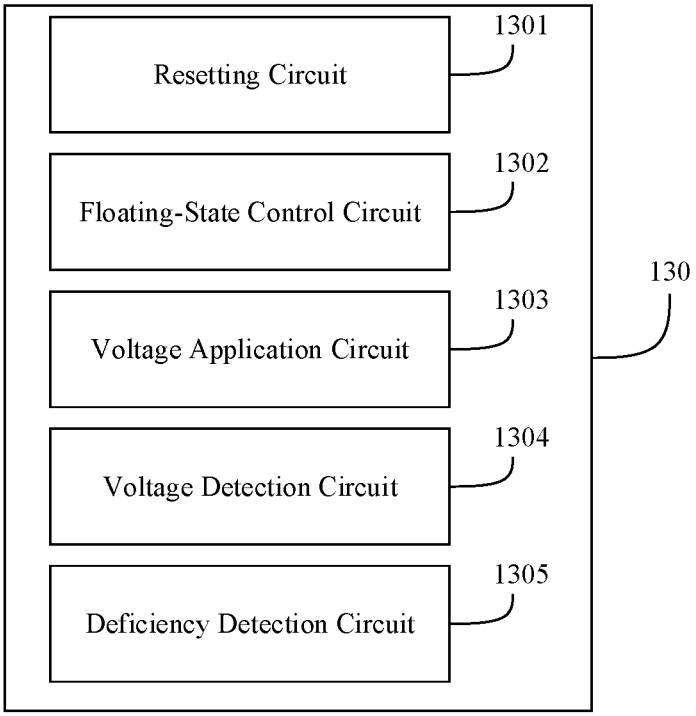
FIG. 13 is a schematic view showing a device for detecting the deficiency of the external compensation line according to one embodiment of the present disclosure.

The present disclosure further provides in some embodiments a device for detecting a deficiency of an external compensation line for use in an external compensation pixel driving circuit connected to a data line, a power source voltage input end, a data write-in control end, an external compensation control end and the external compensation line. As shown in FIG. 13, the device includes: a resetting circuit 1301 configured to, within a resetting time period of each detection stage, apply a resetting voltage to the external compensation line; a floating-state control circuit 1302 configured to, within a detection time period of each detection stage, control the external compensation line to be in a floating state; a voltage application circuit 1303 configured to, within the detection time period of the detection stage, apply a data voltage to the data line, apply a power source voltage to the power source voltage input end, apply a data write-in control voltage to the data write-in control end, apply an external compensation control voltage to the external compensation control end, and transmit a detection control signal to a voltage detection circuit after a detection duration; the voltage detection circuit 1304 configured to detect a voltage across the external compensation line upon the receipt of the detection control signal; and a deficiency detection circuit 1305 configured to determine whether or not there is a short circuit for the external compensation line in accordance with the voltage across the external compensation line. Here, each circuit may be implemented by a common electronic element, e.g., transistor, capacitor, resistor or power source.

According to the device in the embodiments of the present disclosure, with respect to the deficiencies of the external compensation line, the resetting voltage is applied to the external compensation line within the resetting time period of each detection stage, the external compensation line is controlled to be in the floating state within the detection time period of the detection stage after the resetting duration, the corresponding voltages are applied to the data line, the power source voltage input end, the data write-in control end and the external compensation control end respectively, and then the voltage across the external compensation line is detected after the detection duration. As a result, it is able to determine whether or not there is the short circuit for the external compensation line in accordance with the voltage across the external compensation line, and improve a manufacture process and optimize a compensation process in accordance with a detection result, thereby to improve the yield of the product.

Figure 14:
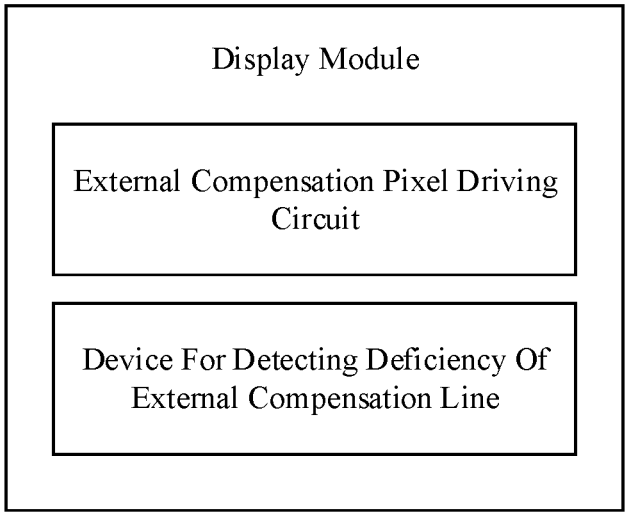
FIG. 14 is a schematic view showing a display module according to one embodiment of the present disclosure.

The present disclosure further provides in some embodiments a display module which, as shown in FIG. 14, includes an external compensation pixel driving circuit and the above-mentioned device for detecting the deficiency of the external compensation line. In a possible embodiment of the present disclosure, the display module may be an OLED display module.

To be specific, the external compensation pixel driving circuit includes: a data write-in transistor, a gate electrode of which is connected to data write-in control end, a first electrode of which is connected to a data line; a driving transistor, a gate electrode of which is connected to a second electrode of the data write-in transistor, a first electrode of which is connected to a power source voltage input end, and a second electrode of which is connected to a first electrode of a light-emitting element; a storage capacitor, a first end of which is connected to the gate electrode of the driving transistor and a second end of which is connected to the second electrode of the driving transistor; and an external compensation control transistor, a gate electrode of which is connected to an external compensation control end, a first electrode of which is connected to the first electrode of the driving transistor, and a second electrode of which is connected to the external compensation line. A second electrode of the light-emitting element is connected to a low level input end.

The above are merely the preferred embodiments of the present disclosure, but the present disclosure is not limited thereto. Obviously, a person skilled in the art may make further modifications and improvements without departing from the spirit of the present disclosure, and these modifications and improvements shall also fall within the scope of the present disclosure.

What is claimed is:

1. A method for detecting a deficiency of an external compensation line for use in an external compensation pixel driving circuit connected to a data line, a power source voltage input end, a data write-in control end, an external compensation control end and the external compensation line, wherein each detection stage comprises a resetting time period and a detection time period, wherein the method comprises steps of:

within the resetting time period of each detection stage, applying a resetting voltage to the external compensation line and entering the detection time period after a resetting duration;

within the detection time period of each detection stage, controlling the external compensation line to be in a floating state, applying a data voltage to the data line, applying a power source voltage to the power source voltage input end, applying a data write-in control voltage to the data write-in control end, applying an external compensation control voltage to the external compensation control end, detecting a voltage across the external compensation line after a detection duration, and determining whether or not there is a short circuit for the external compensation line in accordance with the voltage across the external compensation line;

within a resetting time period of a first detection stage, applying a first resetting voltage to the external compensation line, and entering a detection time period of the first detection stage after a first resetting duration; and within the detection time period of the first detection stage, controlling the external compensation line to be in the floating state, applying a first data write-in control voltage to the data write-in control end so as to turn off a data write-in transistor, applying a first external compensation control voltage to the external compensation control end so as to turn off an external compensation control transistor, applying a first voltage data to the data line, applying a first power source voltage to the power source voltage input end, detecting the voltage across the external compensation line after a first detection duration, determining that there is the short circuit between the external compensation line and the power source voltage input end in the case that an absolute value of a difference between the voltage across the external compensation line and the first power source voltage is smaller than a first voltage threshold, and determining that there is no short circuit between the external compensation line and the power source voltage input end in the case that the absolute value is greater than or equal to the first voltage threshold, wherein an absolute value of a difference between the first data voltage and the first power source voltage is greater than a second voltage threshold, an absolute value of a difference between the first power source voltage and the first resetting voltage is greater than a third voltage threshold, an absolute value of a difference between the first data write-in control voltage and the first power source voltage is greater than a fourth voltage threshold, and an absolute value of a difference between the first external compensation control voltage and the first power source voltage is greater than a fifth voltage threshold.

2. The method according to claim 1, wherein in the case that there is no short circuit between the external compensation line and the power source voltage input end, the method further comprises:

within a resetting time period of a second detection stage, applying a second resetting voltage to the external compensation line, and entering a detection time period of the second detection stage after a second resetting duration; and within a detection time period of the second detection stage, controlling the external compensation line to be in the floating state, applying a second data write-in control voltage to the data write-in control end so as to turn on the data write-in transistor, applying a second external compensation control voltage to the external compensation control end so as to turn off the external compensation control transistor, applying a second data voltage to the data line so as to turned off a driving transistor, applying a second power source voltage to the power source voltage input end, detecting the voltage across the external compensation line after a second detection duration, determining that there is the short circuit between the external compensation line and the data write-in control end in the case that an absolute value of a difference between the voltage across the external compensation line and the second data write-in control voltage is smaller than a sixth voltage threshold, and determining that there is no short circuit between the external compensation line and the data write-in control end in the case that the absolute value is greater than or equal to the sixth voltage threshold, wherein an absolute value of a difference between the second data voltage and the second data write-in control voltage is greater than a seventh voltage threshold, an absolute value of a difference between the second external compensation control voltage and the second data write-in control voltage is greater than an eighth voltage threshold, and an absolute value of a difference between the second data write-in control voltage and the second resetting voltage is greater than a ninth voltage threshold.

3. The method according to claim 2, wherein in the case that there is no short circuit between the external compensation line and the data write-in control end, the method further comprises:

within a resetting time period of a third detection stage, applying a third resetting voltage to the external compensation line, and entering a detection time period of the third detection stage after a third resetting duration; and within the detection time period of the third detection stage, controlling the external compensation line to be in the floating state, applying a third data write-in control voltage to the data write-in control end so as to turn on the data write-in transistor, applying a third external compensation control voltage to the external compensation control end so as to turn on the external compensation control transistor, applying a third data voltage to the data line so as to turn off the driving transistor, applying a third power source voltage to the power source voltage input end, detecting the voltage across the external compensation line after a third detection duration, determining that there is the short circuit between the external compensation line and the external compensation control end in the case that an absolute value of a difference between the voltage across the external compensation line and the third external compensation control voltage is smaller than a tenth voltage threshold, and determining that there is no short circuit between the external compensation line and the external compensation control end in the case that the absolute value greater than or equal to the tenth voltage threshold, wherein an absolute value of a difference between the third data voltage and the third external compensation control voltage is greater than an eleventh voltage threshold, and an absolute value of a difference between the third external compensation control voltage and the third resetting voltage is greater than a twelfth voltage threshold.

4. The method according to claim 3, further comprising, within the detection time period of the third detection stage, comparing the detected voltage across the external compensation line with the third resetting voltage in the case that there is no short circuit between the external compensation line and the external compensation control end, determining that there is no short circuit between the external compensation control end and a second electrode of the driving transistor in the case that an absolute value of a difference between the voltage across the external compensation line and the third resetting voltage is smaller than a thirteenth voltage threshold, and determining that there is a short circuit between the external compensation control end and the second electrode of the driving transistor in the case that the absolute value is greater than or equal to the thirteenth voltage threshold.

5. The method according to claim 4, wherein in the case that there is no short circuit between the external compensation control end and the driving transistor, the method further comprises:

within a resetting time period of a fourth detection stage, applying a fourth resetting voltage to the external compensation line, and entering a detection time period of the fourth detection stage after a fourth resetting duration, an absolute value of a difference between the fourth resetting voltage and a low voltage applied to a low voltage input end being greater than a fourteenth voltage threshold; and within the detection time period of the fourth detection stage, controlling the external compensation line to be in the floating state, applying a fourth data write-in control voltage to the data write-in control end so as to turn off the data write-in transistor, applying a fourth external compensation control voltage to the external compensation control end so as to turn off the external compensation control transistor, applying a fourth data voltage to the data line so as to turn off the driving transistor, applying a fourth power source voltage to the power source voltage input end, detecting the voltage across the external compensation line after a fourth detection duration, determining that there is the short circuit between the external compensation line and the low voltage input end in the case that an absolute value of a difference between the voltage across the external compensation line and the low voltage is smaller than a fifteenth voltage threshold, and determining that there is no short circuit between the external compensation line and the low voltage input end in the case that the absolute value is greater than or equal to the fifteenth voltage threshold, wherein an absolute value of a difference between the fourth data voltage and the fourth resetting voltage is smaller than a sixteenth voltage threshold.

6. The method according to claim 4, wherein in the case that there is not short circuit between the external compensation control end and the second electrode of the driving transistor, the method further comprises:

within a resetting time period of a fifth detection stage, applying a fifth resetting voltage to the external compensation line, and entering a detection time period of the fifth detection stage after a fifth resetting duration; and within the detection time period of the fifth detection stage, controlling the external compensation line to be in the floating state, applying a fifth data write-in control voltage to the data write-in control end so as to turn off the data write-in transistor, applying a fifth external compensation control voltage to the external compensation control end so as to turn off the external compensation control transistor, applying a fifth data voltage to the data line so as to turn on the driving transistor, applying a fifth power source voltage to the power source voltage input end, detecting the voltage across the external compensation line after a fifth detection duration, determining that there is the short circuit between the external compensation line and the data line in the case that an absolute value of a difference between the voltage across the external compensation line and the fifth data voltage is smaller than a seventeenth voltage threshold; and determining that there is no short circuit between the external compensation line and the data line in the case that the absolute value is greater than or equal to the seventeenth voltage threshold, wherein an absolute value of a difference between the fifth data voltage and the fifth resetting voltage is greater than an eighteenth voltage threshold.

7. A device for detecting a deficiency of an external compensation line for use in an external compensation pixel driving circuit connected to a data line, a power source voltage input end, a data write-in control end, an external compensation control end and the external compensation line, applied to perform the method according to claim 1.

8. A display module comprising an external compensation pixel driving circuit and the device according to claim 7.

9. The display module according to claim 8, wherein the external compensation pixel driving circuit comprises:

a data write-in transistor, a gate electrode of which is connected to data write-in control end, a first electrode of which is connected to a data line;

a driving transistor, a gate electrode of which is connected to a second electrode of the data write-in transistor, a first electrode of which is connected to a power source voltage input end, and a second electrode of which is connected to a first electrode of a light-emitting element;

a storage capacitor, a first end of which is connected to the gate electrode of the driving transistor and a second end of which is connected to the second electrode of the driving transistor; and an external compensation control transistor, a gate electrode of which is connected to an external compensation control end, a first electrode of which is connected to the first electrode of the driving transistor, and a second electrode of which is connected to the external compensation line, wherein a second electrode of the light-emitting element is connected to a low level input end.

* * * * *